United States Patent [19]

Dreckmann et al.

[11] Patent Number: 4,614,472

[45] Date of Patent: Sep. 30, 1986

[54] APPARATUS FOR THE MANIPULATION OF PLASTIC BAGS

[75] Inventors: Karl Dreckmann, Hennef-Altenbödingen; Wolfgang Müller, Troisdorf-Kriegsdorf, both of Fed. Rep. of Germany

[73] Assignee: Lemo M. Lehmacher & Sohn GmbH Maschinenfabrik, Niederkassel-Mondorf, Fed. Rep. of Germany

[21] Appl. No.: 657,771

[22] Filed: Oct. 4, 1984

[30] Foreign Application Priority Data

Oct. 4, 1983 [DE] Fed. Rep. of Germany ..... 3335945

[51] Int. Cl.[4] ..... B65H 29/06

[52] U.S. Cl. ..... 414/27; 414/72

[58] Field of Search ..... 414/27, 72; 271/903, 271/186, 187; 198/403, 404

[56] References Cited

U.S. PATENT DOCUMENTS 2,790,533 4/1957 Osgood ..... 198/404

FOREIGN PATENT DOCUMENTS 3004220 8/1981 Fed. Rep. of Germany .

3004244 8/1981 Fed. Rep. of Germany .

3138221 6/1982 Fed. Rep. of Germany .

*Primary Examiner*—Joseph E. Valenza

*Assistant Examiner*—Janice Krizek

*Attorney, Agent, or Firm*—Karl F. Ross; Herbert Dubno

[57] ABSTRACT

An apparatus for the manipulation of plastic bags output from an automatic bag machine comprises an input conveyor for receiving bag elements from the bag machine, a delivery unit having two outer turnstiles spaced from one another according to the width of the bag elements, and a stacking unit. The turnstiles have suction arms to firmly hold bag elements taken from the input conveyor. The bag elements are depositable on the intermittently operated stacking unit. The stacking unit comprises an endless stacking conveyor belt provided with a plurality of pegs thereon, these pegs being spaced from one another according to the stack size. The stack-conveyor belt comprises two conveyor chains with the aforementioned pegs attached thereto, said chains being spaced from one another with a passage space therebetween. The delivery unit further comprises an additional middle turnstile and this middle turnstile is movable through the passage space between the conveyor chains. The middle turnstile performs as a double turnstile so as to be able to manipulate two plastic bags.

1 Claim, 3 Drawing Figures

APPARATUS FOR THE MANIPULATION OF PLASTIC BAGS

FIELD OF THE INVENTION

Our present invention relates to the manipulation of plastic bags downstream of a bag-making machine.

BACKGROUND OF THE INVENTION

Apparatus for the manipulation of plastic bags following a bag-making machine can comprise an input conveyor for receiving bag elements, a delivery unit with outer turnstiles spaced from one another according to the width of the bag elements, and a stacking unit.

The turnstiles can have a plurality of radially disposed suction arms to firmly grasp the bag elements received from the input conveyor and place the bag elements on the intermittently operated bag-stacking unit.

The stacking unit can have an endlessly running stacking conveyor belt with stacking pegs provided which are arranged in accordance with the stack spacing.

In a prior-art apparatus, for example that of German Pat. No. DE-OS 31 38 221, the stacking-apparatus conveyor has a single centrally running conveyor chain with two rows of pegs spaced side-by-side thereon. The transport apparatus has only the outer turnstiles which are spaced from one another.

The lack of a middle turnstile in the delivery apparatus is a disadvantage and apparently such construction was due to the fear of possible collision of a middle turnstile with the conveyor chain.

This previously described structure also limits the versatility of the known apparatus.

Further, the prior-art apparatus can only work with bag elements that are incompletely finished bags. It acts on almost flattened plastic foil strips which have edge welds running perpendicular to one another and are separated each from the other. Since, from these bag elements, two distinct bags are to be constructed, the stacking apparatus must be equipped with additional implements.

It is totally impossible to manufacture sine-shaped bags (i.e. bags with sinusoidal contours) of this invention using the prior-art apparatus. Sine-shaped bags are distinguished from previously known bags by having a more or less sine shape at the opening and at the hand grips. The prior-art bag-manipulating apparatus cannot work behind a bag-making machine which is equipped to produce this kind of sine-shaped bag (for comparison, see German Pat. Nos. DE-OS 30 04 220 and DE-OS 30 04 244).

OBJECTS OF THE INVENTION

It is the principal object of the invention to provide an apparatus that can not only manipulate bag elements which are flat, foil pieces or incomplete bags, but also finished bags, and particularly the above-mentioned sine-shaped bags.

Another object is to provide an apparatus which can follow an automatic bag-making machine that is structured to produce sine-shaped bags wherein pairs of such latter type bags are simultaneously and juxtaposedly constructed in a continuous manner.

SUMMARY OF THE INVENTION

These objects are attained in that the stacking-unit conveyor of the apparatus according to the invention is provided with two conveyor chains that have pegs with a passage space between the chains which feed into the middle of the stacking unit. The delivery unit of the apparatus has an additional middle turnstile near the stacking unit and this middle turnstile is movable through the passage space between both conveyor chains.

The basis of the invention is the recognition that a collision of the working turnstiles with the stacking-unit conveyor can be avoided when this conveyor has two conveyor chains spaced from one another in the described manner with a passage space therebetween. Advantageously, the bag elements are more firmly held and manipulated with the help of the middle turnstile acting on the bag elements, i.e. pieces cut from foil strip as is customary. There is also the possibility, according to the invention, of manipulating two side-by-side bags. Particularly, sine-shaped bags can thus also be handled. The inventive apparatus is adaptable for working behind a bag-making machine such as the bag-making machines of German Pat. Nos. DE-OS 30 04 220 and DE-OS 30 04 244.

The invention is especially characterized by the middle turnstile which performs as a double turnstile and is constructed and arranged for taking up and depositing two separate plastic bags lying side-by-side transverse to the direction of transport from the middle of the input conveyor onto the stacking unit by the delivery unit.

BRIEF DESCRIPTION OF THE DRAWING

The above and other objects, features and advantages of the invention will now be described in detail with reference to the accompanying drawing which shows a specific embodiment in schematic form. In the drawing.

SPECIFIC DESCRIPTION

Figure 1:
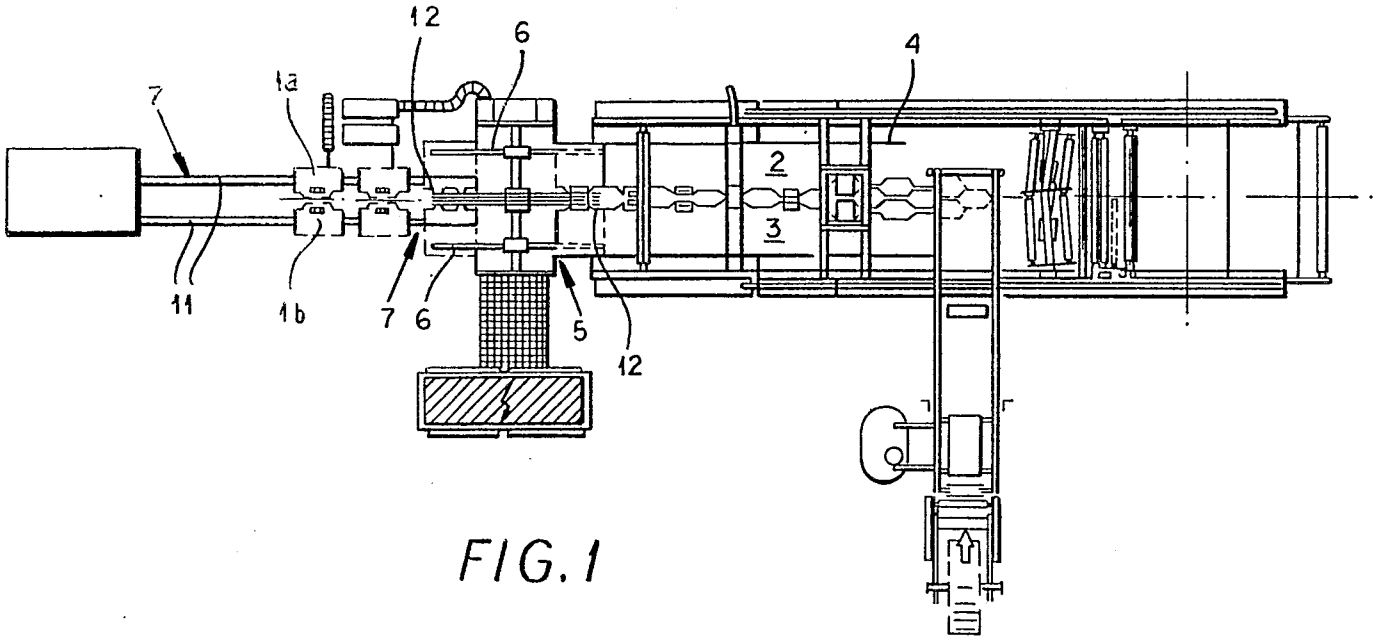
FIG. 1 is a top plan view of the apparatus according to the invention.
Figure 2:
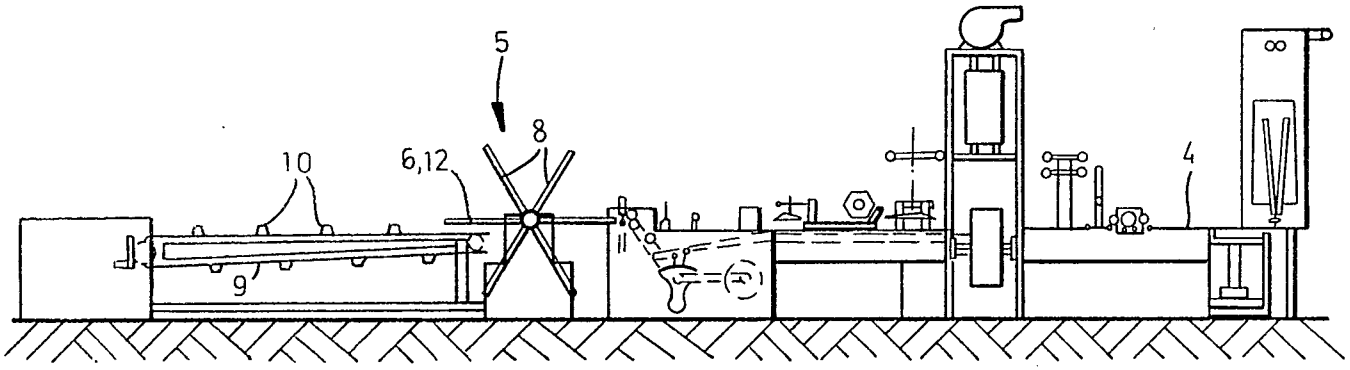
FIG. 2 is a side view of the apparatus of FIG. 1.

The apparatus shown in the drawing serves for manipulation of plastic bags issuing from an automatic bag-making machine (not shown). The basic structure of this apparatus comprises an input conveyor 4 receiving bag elements 2 and 3 from the automatic bagger, a delivery unit 5 having outer turnstiles 6 and a middle turnstile 12 spaced from one another in accordance with the width of the bag, and a pin-stacking unit 7.

The turnstiles 6 and 12 are comprised of a plurality of radially disposed suction arms 8. The turnstiles 6 are so oriented that the axis of their rotation is transverse to the bag-feed direction. The suction arms 8 are of a sufficient length to engage the bags approaching the delivery unit 5 on input conveyor 4. The suction arms 8 of turnstiles 6 hold fast the bag elements 2 and 3 on the intermittently operated stacking unit 7. This unit engages a conveyor belt 9 provided with stacking pegs 10 that are positioned according to the proportions of the stack spacing and are adjustable accordingly.

Figure 3:
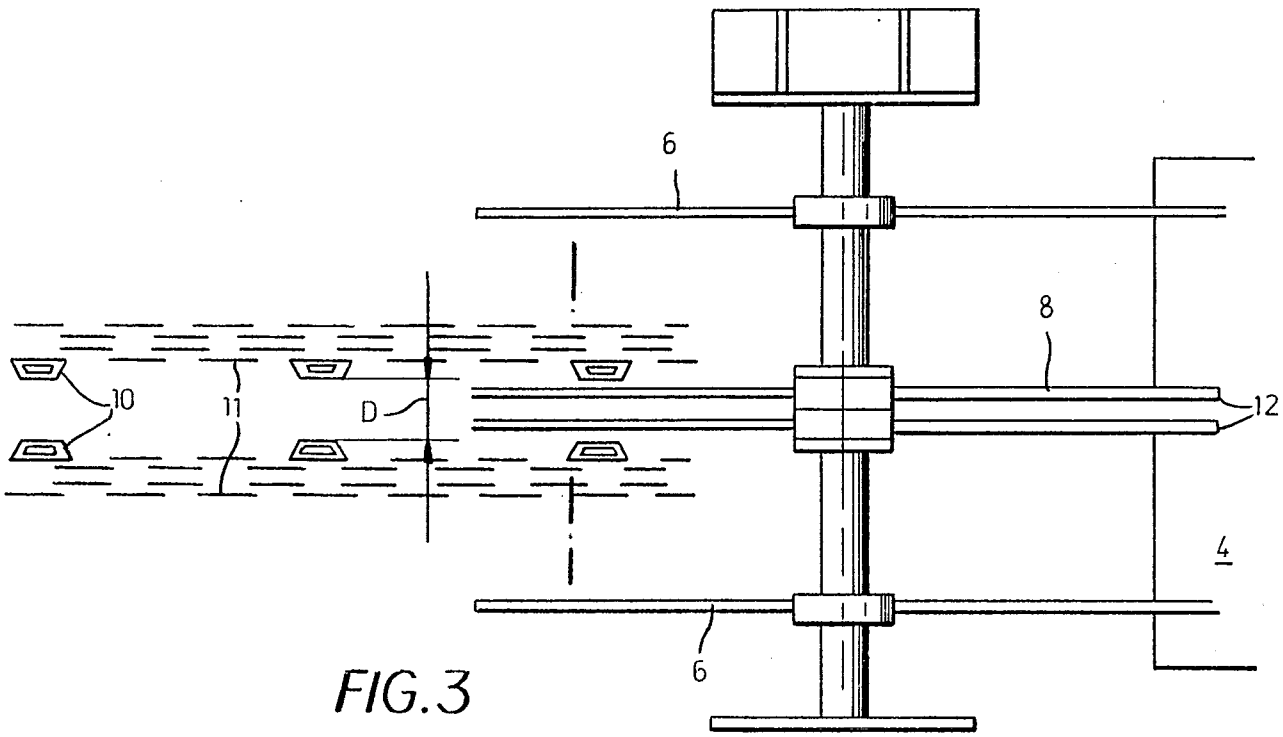
FIG. 3 is an enlarged cutaway portion of the apparatus according to FIG. 1.

One can see particularly from FIGS. 1 and 3 that the conveyor 9 of the stacking unit 7 has two conveyor belt chains 11 provided with stacking pegs 10 and positioned opposing one another with a passage space D therebetween, these chains extending into the turnstiles. The delivery unit 5, including an additional middle turnstile 12, leads to the stacking unit 7. Delivery unit 5 is formed so that the middle turnstile 12 may be rotated through passage space D between both conveyor chains 11. Particularly, one concludes the following from FIG. 3: that the middle turnstile 12 performs as a double turnstile and by this means takes and deposits two separate plastic bags formed laterally lying side-by-side in the transport direction which were pushed into the delivery unit 5 by the input conveyor 4 on the stacking unit 7.

In this specific embodiment the inventive apparatus cooperates in such a way that the sine-like bags of the aforedescribed construction will be efficiently manipulated. They will be held firmly in the delivery unit 5 near their bottoms in the vicinity of the suction arms 8 of the previously described turnstiles 6 and 12 and especially within the grasp of the suction arm 8 of the middle turnstile 12. The apparatus presented herein is however universal, being applicable to other bag-making machines.

We claim:

1. In an apparatus for the manipulation of plastic bag elements outputted from an automatic bag machine, said apparatus comprising an input conveyor for receiving bag elements output from said automatic bag machine, a delivery unit having two outer turnstiles spaced from one another according to the width of said bag elements, and an intermittently operated bag-stacking unit, said turnstiles having suction arms for firmly holding said bag elements grasped from said input conveyor and deposited on the intermittently operated stacking unit, said bag-stacking unit having an endless stacking conveyor provided with a plurality of pegs attached thereto, said pegs being spaced from one another so as to conform to the spacing of said bag elements, the improvement wherein:

said stacking conveyor has two conveyor chains transversely spaced from one another by an intervening space, each of said chains having respective ones of said pegs attached thereto and upstanding therefrom whereby the pegs of each conveyor chain are adapted to carry respective separated and transversely offset bag elements with handle portions thereof impaled on the respective peg, said conveyor chains in transversely spaced relationship from one another extend into the turnstile, said delivery unit includes an additional middle turnstile with a plurality of suction arms positioned in the intervening space between said chains and spaced from but located between said outer turnstiles whereby each arm of said outer turnstiles engages a bottom of a respective bag element while a corresponding arm of said middle turnstile engages the handle portion of the respective bag, said middle turnstile is formed as a double turnstile with its arms paired so that each pair of arms take up from said input conveyor and deposit upon said stacking unit two separate finished plastic bags lying opposite one another transverse to the transport direction by engagement with respective handle portions, and said turnstiles are coupled for synchronous rotation.

* * * * *